US008656671B1

(12) United States Patent
Chambers

(10) Patent No.: US 8,656,671 B1
(45) Date of Patent: Feb. 25, 2014

(54) FLOOR SYSTEMS

(76) Inventor: Robert X. Chambers, Malvern, PA (US)

( * ) Notice: Subject to any disclaimer, the term of this patent is extended or adjusted under 35 U.S.C. 154(b) by 77 days.

(21) Appl. No.: 13/527,031

(22) Filed: Jun. 19, 2012

Related U.S. Application Data

(60) Provisional application No. 61/541,463, filed on Sep. 30, 2011.

(51) Int. Cl.
*E04B 1/70* (2006.01)
*E04F 17/00* (2006.01)
*E04F 13/08* (2006.01)

(52) U.S. Cl.
CPC ..... *E04F 13/0833* (2013.01)
USPC ..... 52/302.1

(58) Field of Classification Search
CPC ..... E04F 2201/05; E04F 2201/0517; E04F 13/07; E04F 13/0801; E04F 13/0833; E04F 13/0853; E04F 13/0844; E04F 13/0846
USPC ..... 52/302.1, 474, 479, 480, 483.1, 489.1, 52/489.2, 403.1, 509, 510, 511, 512, 52/582.1, 589.1
See application file for complete search history.

(56) References Cited

U.S. PATENT DOCUMENTS

| | | | | | |
|---|---|---|---|---|---|
| 1,799,400 | A | | 4/1931 | Tucker | |
| 2,317,015 | A | * | 4/1943 | Allen | 52/512 |
| 2,317,428 | A | * | 4/1943 | Anderson | 52/509 |
| 2,368,620 | A | | 2/1945 | Strom | |
| 2,539,038 | A | | 1/1951 | Shumaker | |
| 2,807,993 | A | * | 10/1957 | Ericson | 454/298 |
| 3,271,916 | A | * | 9/1966 | Omholt | 52/393 |
| 3,420,025 | A | | 1/1969 | Portz | |
| 3,553,919 | A | * | 1/1971 | Omholt | 52/506.1 |
| 3,577,694 | A | | 5/1971 | Omholt | |
| 3,713,264 | A | | 1/1973 | Morgan | |
| 4,009,548 | A | * | 3/1977 | Hicks | 52/469 |
| 4,255,914 | A | | 3/1981 | Seipos | |
| 4,408,433 | A | * | 10/1983 | Scherrer | 52/506.06 |
| 4,429,508 | A | * | 2/1984 | Sizemore | 52/713 |
| 4,467,578 | A | * | 8/1984 | Weinar | 52/281 |
| 4,471,593 | A | * | 9/1984 | Ragland | 52/489.2 |
| 4,599,842 | A | | 7/1986 | Counihan | |

(Continued)

FOREIGN PATENT DOCUMENTS

| | | | |
|---|---|---|---|
| CA | 2287063 | A1 | 4/2000 |
| EP | 997591 | A2 | 5/2000 |

(Continued)

OTHER PUBLICATIONS

Robbins Sports Surfaces, http://www.robbinsfloor.com/homepage.html (last visited Jun. 28, 2011.

(Continued)

*Primary Examiner* — Mark Wendell
*Assistant Examiner* — Keith Minter
(74) *Attorney, Agent, or Firm* — Gerry J. Elman; Elman Technology Law, P.C.

(57) ABSTRACT

Floor systems comprising at least one elongated channel which engages with subfloor and/or floor materials, and which includes at least one slot through which a bracket engages to movably anchor the channel to a concrete floor. The subfloor and/or floor materials are supported underneath by resilient, shock-absorbing material.

14 Claims, 2 Drawing Sheets

(56) References Cited

U.S. PATENT DOCUMENTS

| | | | | |
|---|---|---|---|---|
| 4,633,636 | A * | 1/1987 | Alexander | 52/512 |
| 4,856,250 | A | 8/1989 | Gronau et al. | |
| 5,016,413 | A | 5/1991 | Counihan | |
| 5,497,590 | A | 3/1996 | Counihan | |
| 5,526,621 | A | 6/1996 | Shelton | |
| 5,647,183 | A | 7/1997 | Counihan | |
| 5,778,621 | A | 7/1998 | Randjelovic | |
| 5,906,082 | A | 5/1999 | Counihan | |
| 5,941,040 | A * | 8/1999 | McAnallen et al. | 52/586.1 |
| 6,073,409 | A | 6/2000 | Chambers | |
| 6,122,873 | A | 9/2000 | Randjelovic | |
| 6,158,185 | A | 12/2000 | Counihan | |
| 6,289,646 | B1 * | 9/2001 | Watanabe | 52/506.01 |
| 6,418,693 | B2 | 7/2002 | Ballard | |
| 6,688,065 | B2 | 2/2004 | Chambers | |
| 7,121,052 | B2 | 10/2006 | Niese et al. | |
| 7,383,663 | B2 | 6/2008 | Pacione | |
| 7,398,623 | B2 * | 7/2008 | Martel et al. | 52/489.2 |
| 7,412,806 | B2 | 8/2008 | Pacione et al. | |
| 7,533,500 | B2 * | 5/2009 | Morton et al. | 52/177 |
| 7,546,717 | B2 * | 6/2009 | Juan Puerta | 52/586.1 |
| 7,607,219 | B2 * | 10/2009 | Haytayan | 29/798 |
| 7,694,484 | B2 * | 4/2010 | Lucas et al. | 52/582.1 |
| 7,797,902 | B2 * | 9/2010 | Hikai et al. | 52/506.05 |
| 7,805,902 | B2 * | 10/2010 | Martel | 52/489.1 |
| 7,841,149 | B2 * | 11/2010 | Jahn et al. | 52/506.08 |
| 7,874,113 | B2 * | 1/2011 | Eberle, III | 52/403.1 |
| 8,011,153 | B2 * | 9/2011 | Orchard | 52/489.1 |
| 8,341,901 | B2 * | 1/2013 | Loyd | 52/235 |
| 8,347,577 | B2 * | 1/2013 | Aboukhalil | 52/489.1 |
| 2001/0015042 | A1 | 8/2001 | Ballard | |
| 2001/0025463 | A1 * | 10/2001 | Rudduck | 52/474 |
| 2002/0100248 | A1 * | 8/2002 | D'agata | 52/763 |
| 2002/0121064 | A1 * | 9/2002 | Erwin | 52/586.1 |
| 2003/0051431 | A1 * | 3/2003 | Bousquet | 52/712 |
| 2003/0110726 | A1 * | 6/2003 | Rudduck | 52/474 |
| 2004/0045244 | A1 * | 3/2004 | Hafner | 52/489.1 |
| 2005/0257473 | A1 | 11/2005 | Shaw et al. | |
| 2007/0062431 | A1 * | 3/2007 | Kimble | 114/85 |
| 2008/0053026 | A1 * | 3/2008 | Voegele | 52/582.1 |
| 2008/0155927 | A1 * | 7/2008 | Wendt et al. | 52/506.07 |
| 2009/0193744 | A1 * | 8/2009 | Mellett | 52/479 |
| 2010/0126091 | A1 * | 5/2010 | Meyer | 52/222 |
| 2010/0236180 | A1 | 9/2010 | Pacione et al. | |
| 2010/0251652 | A1 * | 10/2010 | Golden et al. | 52/489.1 |
| 2010/0257806 | A1 * | 10/2010 | Snell et al. | 52/483.1 |
| 2012/0110944 | A1 * | 5/2012 | Hess | 52/582.1 |
| 2013/0097833 | A1 * | 4/2013 | Pacione et al. | 29/402.08 |
| 2013/0125492 | A1 * | 5/2013 | Molek et al. | 52/489.1 |

FOREIGN PATENT DOCUMENTS

| | | | |
|---|---|---|---|
| GB | 2241001 | A | 8/1991 |
| WO | 9964699 | A1 | 12/1999 |
| WO | 2009067814 | A1 | 7/2009 |
| WO | 2010096448 | A1 | 8/2010 |

OTHER PUBLICATIONS

Connor Sports Court International, http://www.connorfloor.com/products-wood_systems-sectional_channel.php (last visited Jun. 28, 2011).

Signature Sports Flooring, http://www.signaturesportsflooring.com/hardwood-basketball-floor.php (last visited Jun. 28, 2011).

Mondo Indor Sport, http://www.mondoworldwide.com/FlooringUSA_IndoorSport_Products_WoodSystems_FastBreakSystem2_FastBreakSystem2Wood_en.cfm (last visited Jun. 28, 2011).

Flex Court Athletics, http://www.flexcourt.com/gym-flooring.php (last visited Jun. 28, 2011).

Sport Court, http://www.sportcourt.com/commercial/sport/basketball.php (last visited Jun. 28, 2011).

Gerflor North America, http://www.gerflorsport.com/us/sport/ranges/product-lines.html (last visited Jun. 28, 2011).

Snap Sports, Inc., http://www.snapsports.com/comsurfaceIn.html (last visited Jun. 28, 2011).

No Fault Sport Group, http://www.nofault.com/products.php?action=show_products&id=14 (last visited Jun. 28, 2011).

Hammerhead Athletic Flooring, Inc., http://www.hammerheadinc.com/Wboflexillu.htm (last visited Jun. 28, 2011).

Dynamic Sports Construction, Inc., http://www.dynamicsportsconstruction.com/dynacourt.htm (last visited Jun. 28, 2011).

* cited by examiner

FLOOR SYSTEMS

CROSS-REFERENCE TO RELATED APPLICATIONS

This application claims the benefit under 35 U.S.C. §119 of U.S. provisional patent application 61/541,463 for Improvements to Floor systems, filed Sep. 30, 2011. The entire contents of the aforementioned application are incorporated herein by reference.

BACKGROUND OF THE INVENTION

1. Field of the Invention

The present invention relates generally to floor systems. More particularly, the present invention concerns an athletic floor system and a method of assembly. The product and method for constructing an athletic floor allow for flooring to be more cost-effective while retaining the same amount of springiness afforded by more expensive flooring systems.

2. Discussion of the Prior Art

A shock-absorbent athletic floor system without vibrations has been the goal of many previous efforts by others. Many athletic floors are either too loose and have floating members and dead spots, or are fastened so tight that there is little or no shock-absorbing capacity. Moreover, many prior art floors are difficult to install and suffer from having guide channels that are rendered immobile because they are fastened directly to a concrete foundation. In such systems, the insertion of springs, foam pads, and/or the like into the subfloor does not overcome the fact that the guide channels are pinned down directly to the foundation, eliminating the possibility for the system to breath and rise above the foundation beneath it. This is but one example of non-optimal design in flooring systems of the prior art and is not necessarily present in all previous flooring systems. Nevertheless, through the summary of the invention and the detailed description of the drawings in the ensuing disclosure, benefits of the presently disclosed flooring system over prior art systems become apparent.

Examples of earlier flooring systems are disclosed in the following references: U.S. Pat. No. 1,799,400; U.S. Pat. No. 2,317,015; U.S. Pat. No. 2,317,428; U.S. Pat. No. 2,368,620; U.S. Pat. No. 2,539,038; U.S. Pat. No. 3,271,916; U.S. Pat. No. 3,420,025; U.S. Pat. No. 3,577,694; U.S. Pat. No. 3,713,264; U.S. Pat. No. 4,255,914; U.S. Pat. No. 4,599,842; U.S. Pat. No. 4,856,250; U.S. Pat. No. 5,016,413; U.S. Pat. No. 5,497,590; U.S. Pat. No. 5,526,621; U.S. Pat. No. 5,647,183; U.S. Pat. No. 5,778,621; U.S. Pat. No. 5,906,082; U.S. Pat. No. 6,073,409; U.S. Pat. No. 6,122,873; U.S. Pat. No. 6,158,185; U.S. Pat. No. 6,418,693; U.S. Pat. No. 6,688,065 B2; U.S. Pat. No. 7,383,663 B2; and U.S. Pat. No. 7,412,806 B2.

SUMMARY OF THE INVENTION

This presently disclosed subject matter concerns floor systems that are adapted to allow floor slats (alternatively referred to as "boards") to translate up and down within defined limits, and methods of assembling the floor systems. The floor systems disclosed herein operate in conjunction with sections of floor material that are elevated above a solid foundation with foam, one or more rubber pads, and/or the like. As disclosed herein, due to the arrangement and shapes of the components of floor systems in accordance with the present invention, once assembled, one or more tunnels exist below the top surface of the floor, allowing air to flow therethrough. Due to the indirect anchoring of the sections of floor material to a solid foundation, such as a concrete floor, as described herein, each section of floor is allowed to independently translate upward and downward in a shock-absorbing manner.

In one embodiment of a floor system according to the presently disclosed subject matter, elongated channels having a vertical planar portion and a horizontal planar portion, which have an inverted L-shape, when viewed in cross-section, run lengthwise along the sides of sections of subfloor material. The horizontal and vertical planar sections of such a channel engage with at least one section of subfloor material and indirectly anchor it to the solid foundation below. The channel is movably anchored to the solid foundation with at least one bracket which is directly anchored to the foundation and which slidably engages with the channel through a slot located in the vertical plane of the channel. In such an embodiment, the one or more sections of the layer of subfloor material with which the channel interfaces are below a top layer of sections of floor material, which are affixed thereto.

In another embodiment according to the presently disclosed subject matter, one or more channels having a T-shape, when viewed in cross-section, interfaces with the ends of sections of floor material. Unlike the embodiment with the inverted L-shaped channel discussed above, the T-shaped channels of this embodiment interface with sections of floor material that are not below another layer of floor or subfloor material, but rather are the top and, preferably, the only layer of floor slats. This gives the floor system a low profile. Each T-shaped channel according to this embodiment also includes at least one slot in the vertical plane through which an anchored bracket slidably engages with the channel.

The sections of floor or subfloor with which the channels engage are supported underneath by a resilient, shock-absorbing material, such as rubber pads, which are preferably evenly spaced, a layer of foam, or the like. The resilient, shock-absorbing supporting material affords sections of floor supported thereon a certain measure of springiness. In one embodiment which includes the inverted L-shaped channel, a ¾-inch layer of maple slats is nailed to a ¾-inch layer of plywood. Such an embodiment is primarily adapted for gymnasiums. It provides a cost-efficient alternative to standard maple floor, which normally uses maple slats of higher thickness than the ¾-inch slats. Of course, floor sections comprising a material other than slats of maple may be employed, but maple is preferable. A second embodiment, in which the T-shaped channels interface directly with a top layer of floor slats, which are preferably maple, is a cost-efficient alternative to more expensive floors, while providing roughly the same amount of springiness.

A first aspect of the invention is a floor system comprising:

at least one channel comprising:

a horizontal portion;

a vertical planar portion which is adjacent and oriented substantially at a right angle to said horizontal planar portion; and at least one slot in said vertical planar portion, said slot being oriented lengthwise along said vertical portion and having a first portion with a first height and an adjacent second portion having a second height which is less than the first height;

at least one bracket comprising:

a vertical planar portion;

a horizontal planar portion which is adjacent and oriented substantially at a right angle to said vertical planar portion; and an inverted U-shaped portion which is connected to said vertical planar portion.

A second aspect of the invention is a floor system as disclosed in the first aspect of the invention, wherein said at least one channel further comprises at least one end in which a sub-portion of said vertical planar portion is bent substantially perpendicular to the remainder of the vertical planar portion and is substantially perpendicular to said horizontal planar portion of the channel.

A third aspect of the invention is a floor system as disclosed in the first aspect of the invention, wherein said at least one channel further comprises at least one end in which a sub-portion of said horizontal planar portion is bent substantially perpendicular to the remainder of the horizontal planar portion and is substantially parallel with said vertical planar portion of the channel.

A fourth aspect of the invention is a floor system as disclosed in the first aspect of the invention, wherein said at least one channel is T-shaped in cross section.

A fifth aspect of the invention is a floor system as disclosed in the first aspect of the invention, wherein said inverted U-shaped portion of one of said at least one brackets is engaged with one of said at least one slots in one of said at least one channels, and the horizontal planar portion of said bracket is anchored into a solid foundation below the bracket.

A sixth aspect of the invention is a floor system as disclosed in the first aspect of the invention, wherein said horizontal planar portion of said at least one channel is disposed across a top surface of at least one section of an intermediate layer of subfloor material.

A seventh aspect of the invention is a floor system as disclosed in the sixth aspect of the invention, wherein said at least one section of the intermediate layer of subfloor material is disposed atop resilient, shock-absorbing material.

An eighth aspect of the invention is a floor system as disclosed in the seventh aspect of the invention, wherein at least one section of a top layer of floor material is anchored to said at least one section of the intermediate layer of subfloor material.

A ninth aspect of the invention is a floor system as disclosed in the fourth aspect of the invention, wherein said inverted U-shaped portion of one of said at least one brackets is engaged with one of said at least one slots in one of said at least one channels, and the horizontal planar portion of said bracket is anchored into a solid foundation below the bracket.

A tenth aspect of the invention is a floor system as disclosed in the fourth aspect of the invention, wherein a first side of said horizontal planar portion of said at least one channel is disposed within a groove in an end of a first section of a top layer of floor material.

An eleventh aspect of the invention is a floor system as disclosed in the tenth aspect of the invention, wherein a second side of said horizontal planar portion of said at least one channel is disposed within a groove in a second end of a second section of the top layer of floor material.

A twelfth aspect of the invention is a floor system as disclosed in the tenth aspect of the invention, wherein the first end of the first section of the top layer of floor material is opposite the second end of the second section of the top layer of floor material.

A thirteenth aspect of the invention is a floor system as disclosed in the tenth aspect of the invention, wherein at least one section of the top layer of floor material is disposed atop resilient, shock-absorbing material.

A fourteenth aspect of the invention is a floor system pursuant to one or a combination of the above aspects of the invention, wherein said solid foundation, said at least one bracket, said at least one channel, and said intermediate layer of subfloor material and/or top layer of floor material define at least one tunnel adapted to allow air to pass therethrough.

A fifteenth aspect of the invention is a method of assembling a floor system according to one or a combination of the above aspects of the invention, comprising:

placing resilient, shock-absorbing materials on a solid foundation;

placing a section of an intermediate layer of subfloor material on top of the resilient, shock-absorbing materials in a side-by-side orientation, leaving gaps between them, wherein the gaps are of the same width as the horizontal portion of the bracket;

positioning the horizontal planar portions of each channel upon each section of the intermediate layer of subfloor material, such that the vertical planar portion of the channel is substantially against a corresponding side of a section of intermediate subfloor material;

inserting and sliding the inverted U-shaped portion of at least one bracket into the longitudinal slot in the vertical planar portion of the corresponding channel;

anchoring at least one bracket to the solid foundation;

placing sections of a top layer of floor material across the top of the intermediate layer of subfloor material, such that no gaps exist between the sections of the top layer of floor material; and anchoring the top layer of floor material to the intermediate layer of subfloor material.

A sixteenth aspect of the invention is a method of assembling a floor system according to one or a combination of the above aspects of the invention, comprising:

placing resilient, shock-absorbing material on a solid foundation;

anchoring at least one bracket into the solid foundation, without any of the resilient, shock-absorbing material between the bracket and the solid foundation;

placing sections of a top layer of floor material over the resilient, shock-absorbing material in an end-to-end manner;

engaging a first side of the horizontal planar portion of the channel with a first groove in an end of a first section of floor material;

engaging a second side of the horizontal planar portion of the channel with a with a second groove in an end of a second section of floor material which is disposed opposite to the first section of floor material; and inserting and sliding the inverted U-shaped portion of the bracket into the longitudinal slot in the vertical planar portion of the channel.

BRIEF DESCRIPTION OF THE DRAWINGS

The following is a brief description of the drawings, which correspond with exemplary embodiments of floor systems in accordance with the present invention.

DETAILED DESCRIPTION

Figure 1:
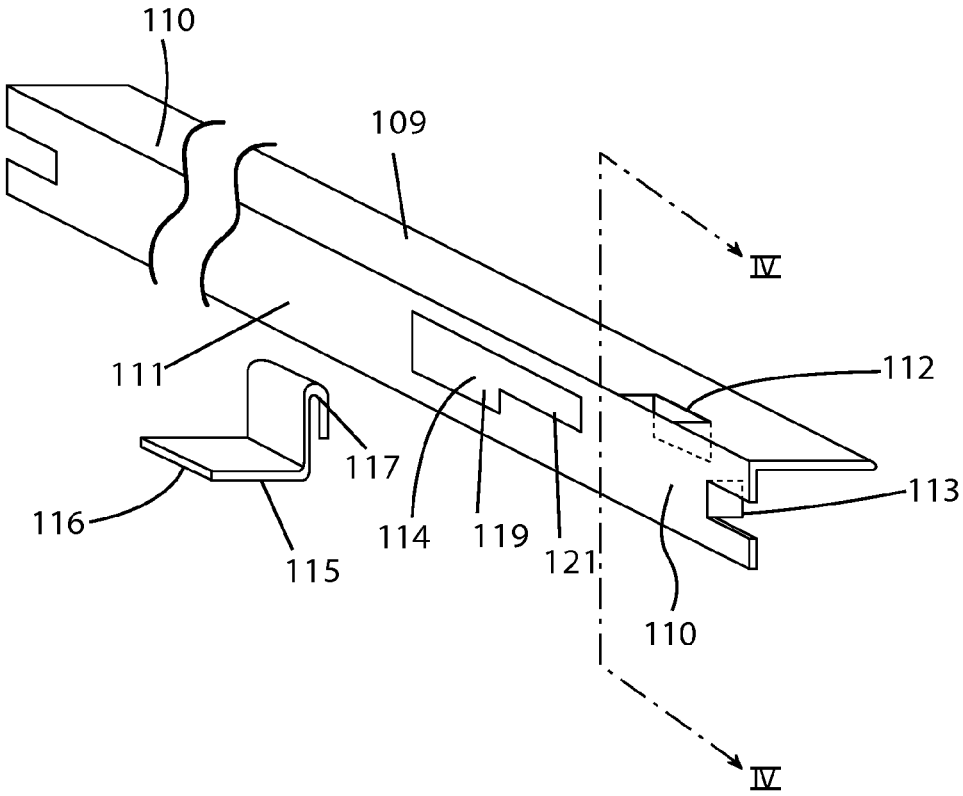
FIG. 1 is a perspective exploded view of an exemplary embodiment of a floor system in accordance with the present invention having an elongated channel with an inverted L-shape.
Figure 4:
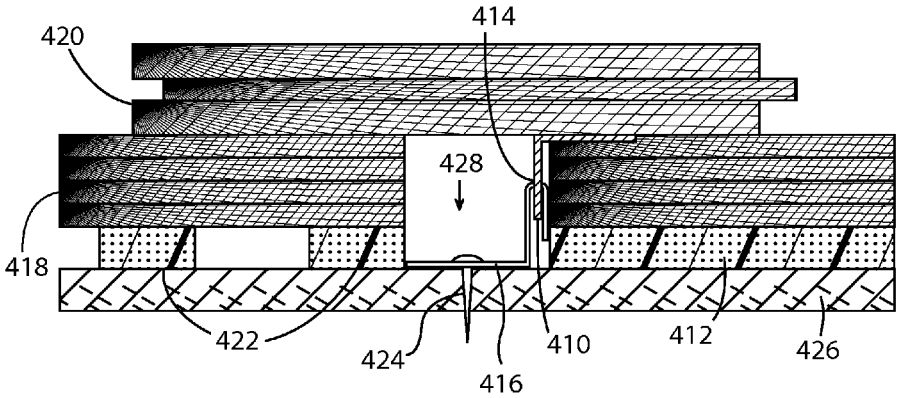
FIG. 4 is a cross-sectional view of an exemplary embodiment of a floor system in accordance with the present invention having an inverted L-shaped channel. The view corresponds with line IV-IV of FIG. 1.

FIG. 1 is a perspective exploded view of an exemplary embodiment of a floor system in accordance with the present invention, including an inverted L-shaped channel 110. The ends the vertical planar portion 111 and the horizontal planar portion 109 of the channel 110 each has a corresponding cut-out portion, 113 and 112, respectively, which is folded 90 degrees. These folded cut-out portions are referred to herein as "spacers", and they prevent an adjacent vertical surface from abutting the corresponding side of the vertical planar portion 111 of the channel 110. The vertical planar portion 111 of the channel 110 includes at least one longitudinal slot 114. The longitudinal slot 114 has a first portion 119 which is taller than the second portion 121. The horizontal planar portion 109 of the channel 110 is adapted to fit over the top of a panel of plywood. In this particular embodiment, the panel of plywood, item 418 in FIG. 4, is ¾" thick. Other thicknesses are within the scope of the presently disclosed subject matter and, in certain instances, may require adjustment in the height of the vertical planar portion 111 and/or changing the placement of the longitudinal slot 114.

The channel 110 is designed to engage with a plywood panel. See FIG. 4, wherein the channel 410 is affixed to plywood panel 418. In turn, a bracket 116 having a horizontal planar portion 115, a vertical planar portion, and an inverted U-shaped portion 117 engages with the channel 110. That is, the inverted U-shaped portion 117 of bracket 116 is placed into the first, taller portion 119 of the longitudinal slot 114. The second, shorter portion 121 of the longitudinal slot 114 is sized to allow the channel 110 to be moveably engaged with the bracket 116, such that the channel 110 may move up and down inside the inverted U-shaped portion 117 of the bracket 116 without becoming disengaged therefrom. The channel 110 can be indirectly nailed, screwed, or otherwise anchored to a solid foundation, for example concrete. See FIG. 3, wherein horizontal planar portion 315 of the bracket 316 anchors the channel 310 to a solid foundation 326.

Figure 2:
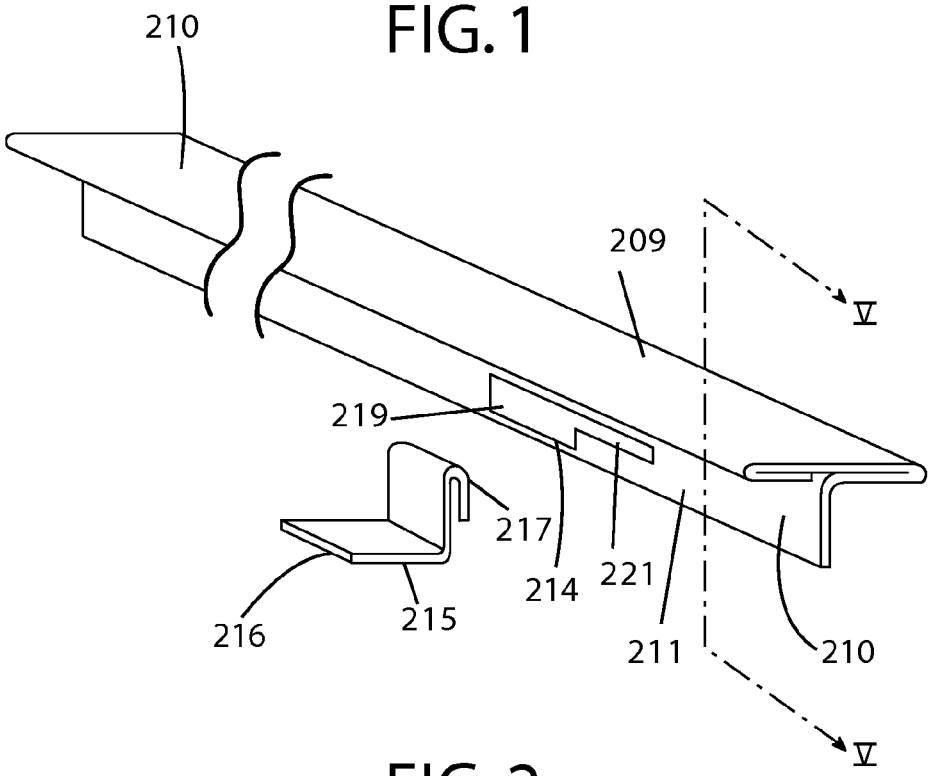
FIG. 2 is a perspective exploded view of an exemplary embodiment of a floor system in accordance with the present invention having an elongated channel with a T-shape.

FIG. 2 is a perspective exploded view of an exemplary embodiment of a floor system in accordance with the present invention, including a T-shaped channel 210. The vertical planar portion 211 of the T-shaped channel 210 has at least one longitudinal slot 214. The longitudinal slot 214 has a first portion 219 which is taller than a second portion 221. The horizontal planar portion 209 of the channel 210 is adapted to fit into corresponding grooves in the ends of floor slats. See FIG. 5, wherein horizontal planar portion 509 of channel 510, which correspond to portion 209 of channel 210, fits into grooves 523 and 525 of floor slats 518. In this particular embodiment, each floor panel 518 is maple and is ¾" thick. Other materials for the floor slats 518 may be used as well, but maple is preferable. In addition, the floor slats 518 may be of a different thickness in other embodiments of the invention.

The vertical planar portion 211 of the T-shaped channel 210 is then engaged by bracket 216. That is, the inverted U-shaped portion 217 is inserted into the first, taller portion 219 of the longitudinal slot 214. The shorter second portion 221 of the longitudinal slot 214 is sized to allow the channel 210 to be moveably engaged with the bracket 216. The channel 210 is then indirectly anchored to a concrete foundation by the bracket 216. The horizontal planar portion 215 of the bracket 216 is anchored to the concrete foundation 326 in FIG. 3 with a nail 324. In other embodiments, a different fastener or adhesive, such as a screw or glue, may be used to anchor the bracket 216 to the foundation 326. It is noted that, in some embodiments adapted for floor slats of a different thickness, the height of the vertical planar portion 211 of the channel 210 and/or the placement of the longitudinal slot 214 differs to accommodate the change in thickness of the floor slats.

Figure 3:
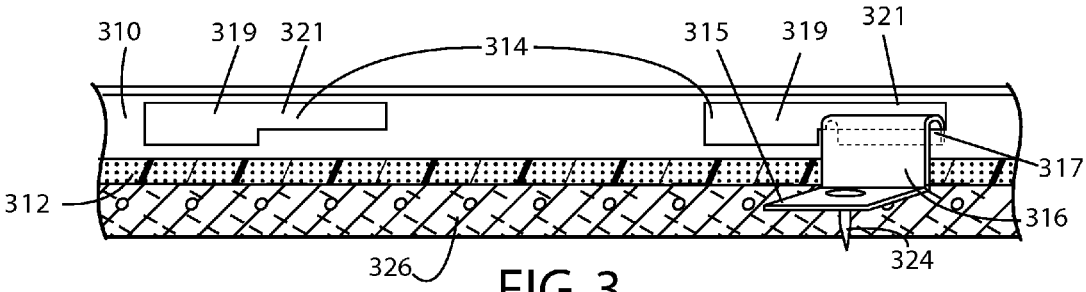
FIG. 3 is a partial perspective view of a channel in accordance with a floor system of the present invention, clearly showing longitudinal slots in the channel.

FIG. 3 is a partial perspective view of a channel in accordance with a floor system of the present invention. FIG. 3 reveals a close-up view of the longitudinal slots 314 in the channel 310. It is noted that this figure is representative of both the inverted L-shaped channel 110 in accordance with FIG. 1 and the T-shaped channel 210 as seen in FIG. 2. Additionally this view reveals the placement of the channel 310 in relation to the resilient, shock-absorbing material, which in FIG. 3 is a layer of foam 312. The channel 310 is engaged by bracket 316. The inverted U-shaped portion 317 of bracket 316 is shown in the second, shorter portion 321 of the longitudinal slot 314, rather than the first, taller portion 319. In this configuration, channel 310 is moveably engaged with the bracket 316, such that channel 310 may move up and down without becoming detached from bracket 316. The bracket 316 is fastened to the concrete foundation 326 with at least one anchor 324 passing through the horizontal planar portion 315 of the bracket 316.

FIG. 4 is a cross-sectional view of an exemplary embodiment of a floor system in accordance with the present invention having an inverted L-shaped channel 410. The view corresponds with line IV-IV of FIG. 1, though additional items are depicted in FIG. 4. The figure illustrates how an embodiment of a floor system is assembled in accordance with the presently disclosed subject matter. The first step is placing resilient, shock-absorbing material, 412 and 422, on a solid foundation 426. In this figure, the solid foundation is concrete 426. The resilient, shock-absorbing material in this embodiment is a layer of foam 412 and spaced-apart pads 422. Of course, while this embodiment shows a combination of a layer of foam 412 and pads 422 atop the solid foundation 426, it should be understood that just a layer of foam 412 or just the pads 422 could be used instead. The spaced-apart pads 422 are preferably rubber, but other resilient, shock-absorbing materials may be used in the pads 422 in addition to or instead of rubber. Additionally, other resilient, shock-absorbing materials other than a layer of foam 412 or pads 422 could be placed on top of the solid foundation 426 instead.

The next step is placing a section of an intermediate layer of subfloor material 418 on top of the resilient, shock-absorbing materials 412 and 422. The sections of the intermediate layer of subfloor material 418 are positioned in a side-by-side orientation, leaving gaps between them. The gaps are of the same width as the horizontal planar portion of the bracket 416. In this example, the intermediate layer of subfloor material is plywood 418. The plywood in this example is ¾" thick. As will be understood by those skilled in the art, other subfloor materials, for example plank boards, oriented strand board ("OSB"), and/or particle board may be placed atop the resilient, shock-absorbing materials, 412 and 422, instead of or in addition to plywood. Also, as those skilled in the art will appreciate, the thickness of the intermediate layer of subfloor material 418 may be more or less than ¾", provided that the cooperating components in the floor system, for example the bracket 416 and/or inverted L-shaped channel 410, are adjusted accordingly.

The next step is positioning the horizontal planar portion of each channel 410 upon each section of the intermediate layer of subfloor material 418, such that the vertical portion of the channel is substantially against a corresponding side of a section of the intermediate layer of subfloor material 418. The next step is inserting the inverted U-shaped portion of bracket 416 into a longitudinal slot in the vertical planar portion of the corresponding channel 410. Preferably, the inverted U-shaped portion of the bracket 416 is inserted into the taller portion of the longitudinal slot 414 and then slid into the shorter portion of the longitudinal slot 414. The next step is anchoring bracket 416 to the solid foundation 426. In this particular embodiment, at least one anchor 424 is set into the horizontal planar portion of the L-shaped bracket 416.

The next step is to place sections of a top layer of floor material 420 across the top of the intermediate layer of subfloor material 418, such that no gaps exist between the sections of the top layer of floor material 420. In this particular embodiment, the top layer comprises ¾" thick, tongue and grooved slats of maple 420 arranged parallel to each other.

As a person skilled in the art will appreciate, other materials and thicknesses may be used for the top layer of floor material 420. The next step is nailing the top layer of floor material 420 to the intermediate layer of subfloor material 418. In this embodiment, the top layer of floor material 420 is nailed to the intermediate layer of subfloor material 418. As shown, in assembled form, a tunnel 428 allows air to flow underneath the top layer of floor material 420 and alongside the sections of the intermediate layer of subfloor material 418 and the resilient, shock-absorbing material 412 and 422.

In other embodiments, screws, tacks, staples, glue, or other mechanisms or substances may be used to affix and/or anchor the above-discussed components. A person skilled in the art, upon reviewing the above-disclosed method and the corresponding FIG. 4, will appreciate that steps recited in the method above may be performed in a different order while still resulting in the same assembly.

Figure 5:
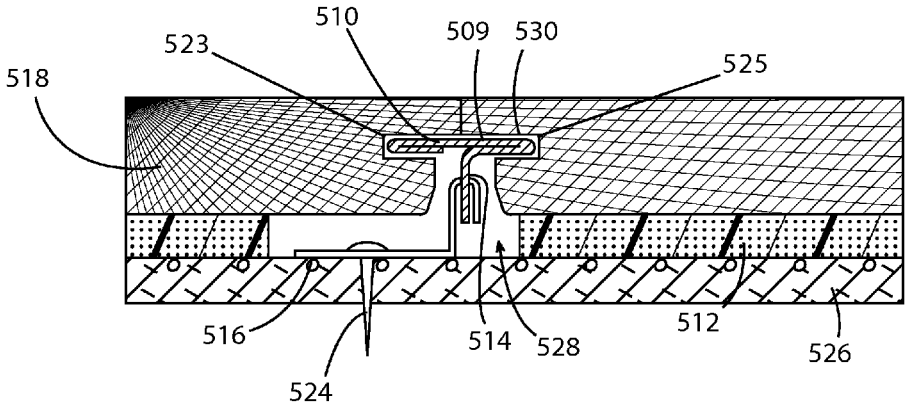
FIG. 5 is a cross-sectional view of an exemplary embodiment of a floor system in accordance with the present invention having a T-shaped channel. The view corresponds with line V-V of FIG. 2.

FIG. 5 is a cross-sectional view of an exemplary embodiment of a floor system in accordance with the present invention having a T-shaped channel 510. The view corresponds with line V-V of FIG. 2, though additional items are depicted in FIG. 5. The figure illustrates how an embodiment of a floor system is assembled in accordance with the presently disclosed subject matter. The first step is placing resilient, shock-absorbing material 512 on a solid foundation 526. In this figure, the solid foundation is concrete 526. The resilient, shock-absorbing material in this embodiment is a layer of foam 512. Additionally or alternatively, other resilient, shock-absorbing materials other than a layer of foam 512 could be placed on top of the solid foundation 526, for example rubber pads.

The next step is anchoring bracket 516 into the solid foundation 526, without any of the resilient, shock-absorbing material 512 between the bracket 516 and solid foundation 526. This may be done by removing resilient, shock-absorbing material 512 at each location where a bracket 516 is to be placed, or by arranging the resilient, shock-absorbing material such that it is otherwise not occupying the space where the bracket 516 is to be positioned. The bracket 516 is anchored to the solid foundation 526 in this embodiment with at least one nail 524.

The next step is placing sections of a top layer of floor material 518 over the resilient, shock-absorbing material. The placement of the sections of the top layer 518 is performed in an end-to-end manner, such that the horizontal planar section of the T-shaped channel engages with a groove 525 in a first end of a first section of floor material 518 and a groove 523 in a second end of a second section of floor material 518 which is disposed opposite to the first section of floor material. In this particular embodiment, the sections of the top layer of floor material 518 comprise maple which is ¾" thick. As a person skilled in the art will appreciate, other materials and thicknesses may be used for the top layer of floor material 518. The next step is inserting the inverted U-shaped portion of bracket 516 into the longitudinal slot 514 on the vertical planar portion of the corresponding channel 510. Preferably, the inverted U-shaped portion is inserted into the taller portion of the longitudinal slot and then slid into the shorter portion of the longitudinal slot. The resulting tunnel 528 beneath the top layer of floor material, as shown in FIG. 5, allows air to flow therethrough.

In alternative embodiment, the method of assembly is as discussed immediately above, with the following difference. After the step of anchoring the bracket 516 to the solid foundation 526, the sections of a top layer 518 of floor material are placed over the resilient, shock-absorbing material 512 and engaged with the channel 510 as follows: A first side of the horizontal planar portion 509 of the channel 510 is engaged with a groove 525 in a first end of a first section of floor material, then the inverted U-shaped portion of the bracket is inserted into the longitudinal slot 514, in the channel 510, then the opposite side of the horizontal portion 509 of the channel 510 is engaged with a groove 523 in a second end of a second section of top floor material, which is disposed opposite to the first section of floor material.

In other embodiments, screws, tacks, staples, glue, or other mechanisms or substances may be used to affix and/or anchor the above-discussed components. A person skilled in the art, upon reviewing the above-disclosed method and the corresponding FIG. 5, will appreciate that steps recited in the method above may be performed in a different order while still resulting in the same assembly.

While preferred embodiments of the disclosed subject matter have been described, so as to enable one of skill in the art to practice the present disclosed subject matter, the preceding description is intended to be exemplary only.

The invention claimed is:

1. A floor system comprising:

at least one channel comprising:

a horizontal portion;

a vertical planar portion which is adjacent and oriented substantially at a right angle to said horizontal planar portion; and at least one slot in said vertical planar portion, said slot being oriented lengthwise along said vertical portion and having a first portion with a first height and an adjacent second portion having a second height which is less than the first height; and at least one bracket comprising:

a vertical planar portion;

a horizontal planar portion which is adjacent and oriented substantially at a right angle to said vertical planar portion; and an inverted U-shaped portion which is connected to said vertical planar portion;

wherein said inverted U-shaped portion of one of said at least one brackets is engaged slidably with one of said at least one slots in one of said at least one channels, and the horizontal planar portion of said bracket is anchored into a solid foundation below the bracket.

2. The floor system of claim 1, wherein said at least one channel further comprises at least one end in which a subportion of said vertical planar portion is bent substantially perpendicular to the remainder of the vertical planar portion and is substantially perpendicular to said horizontal planar portion of the channel.

3. The floor system of claim 1, wherein said at least one channel further comprises at least one end in which a sub-portion of said horizontal planar portion is bent substantially perpendicular to the remainder of the horizontal planar portion and is substantially parallel with said vertical planar portion of the channel.

4. The floor system of claim 1, wherein said at least one channel is T-shaped in cross section.

5. The floor system of claim 4, wherein said inverted U-shaped portion of one of said at least one brackets is engaged slidably with one of said at least one slots in one of said at least one channels, and the horizontal planar portion of said bracket is anchored into a solid foundation below the bracket.

6. The floor system of claim 4, wherein a first side of said horizontal planar portion of said at least one channel is disposed within a groove in an end of a first section of a top layer of floor material.

7. The floor system of claim 6, wherein a second side of said horizontal planar portion of said at least one channel is disposed within a groove in a second end of a second section of the top layer of floor material.

8. The floor system of claim 6, wherein the first end of the first section of the top layer of floor material is opposite the second end of the second section of the top layer of floor material.

9. The floor system of claim 6, wherein at least one section of the top layer of floor material is disposed atop resilient, shock-absorbing material.

10. The floor system of claim 4, wherein said inverted U-shaped portion of one of said at least one brackets is engaged slidably with one of said at least one slots in one of said at least one channels, and the horizontal planar portion of said bracket is anchored into a solid foundation below the bracket;

wherein a first side of said horizontal planar portion of said at least one channel is disposed within a groove in an end of a first section of a top layer of floor material; and wherein said solid foundation, said at least one bracket, said at least one channel, and said top layer of floor material define at least one tunnel adapted to allow air to pass therethrough.

11. The floor system of claim 1, wherein said horizontal planar portion of said at least one channel is disposed across a top surface of at least one section of an intermediate layer of subfloor material.

12. The floor system of claim 11, wherein said at least one section of the intermediate layer of subfloor material is disposed atop resilient, shock-absorbing material.

13. The floor system of claim 12, wherein at least one section of a top layer of floor material is anchored to said at least one section of the intermediate layer of subfloor material.

14. The floor system of claim 1, wherein said inverted U-shaped portion of one of said at least one brackets is engaged slidably with one of said at least one slots in one of said at least one channels, and the horizontal planar portion of said bracket is anchored into a solid foundation below the bracket;

wherein said horizontal planar portion of said at least one channel is disposed across a top surface of at least one section of an intermediate layer of subfloor material;

wherein at least one section of a top layer of floor material is anchored to said at least one section of the intermediate layer of subfloor material; and wherein said solid foundation, said at least one bracket, said at least one channel, said intermediate layer of subfloor material, and said top layer of floor material define at least one tunnel adapted to allow air to pass therethrough.

* * * * *